US010718567B2

(12) United States Patent
Boustead et al.

(10) Patent No.: US 10,718,567 B2
(45) Date of Patent: Jul. 21, 2020

(54) MULTIPLE HEARTH FURNACE IMPROVEMENTS

(71) Applicant: Synergetics Pty Ltd, Victoria (AU)

(72) Inventors: Nicholas Boustead, Hawthorn (AU); James Brett, Pascoe Vale South (AU); David Shanks, Drummoyne (AU)

(73) Assignee: SYNERGETICS PTY LTD, Victoria (AU)

( * ) Notice: Subject to any disclaimer, the term of this patent is extended or adjusted under 35 U.S.C. 154(b) by 139 days.

(21) Appl. No.: 15/174,361

(22) Filed: Jun. 6, 2016

(65) Prior Publication Data

US 2016/0356548 A1 Dec. 8, 2016

(30) Foreign Application Priority Data

Jun. 6, 2015 (AU) ..... 2015902122

(51) Int. Cl.
*F27B 9/02* (2006.01)
*F27D 99/00* (2010.01)
*F27B 9/18* (2006.01)

(52) U.S. Cl.
CPC ..... *F27B 9/028* (2013.01); *F27B 9/02* (2013.01); *F27B 9/024* (2013.01); *F27B 9/185* (2013.01); *F27D 99/0033* (2013.01)

(58) Field of Classification Search
CPC ... C10B 47/34; C10B 7/02; F27B 9/16; F27B 9/18; F27B 9/185; F27B 9/028; F27B 9/02; F27B 9/024
USPC ..... 432/131
See application file for complete search history.

(56) References Cited

U.S. PATENT DOCUMENTS

| | | | | | |
|---|---|---|---|---|---|
| 2,030,734 | A * | 2/1936 | Baird | F26B 17/003 | 159/11.3 |
| 2,116,058 | A * | 5/1938 | Connolly | F23G 5/28 | 110/225 |
| 2,125,720 | A * | 8/1938 | Hartley | F23G 5/28 | 110/222 |
| 2,361,557 | A * | 10/1944 | Martin | F27B 9/24 | 414/151 |
| 3,448,012 | A | 6/1969 | Allred | | |
| 3,650,830 | A * | 3/1972 | Mathis | C22B 21/0069 | 134/25.1 |
| 3,905,757 | A * | 9/1975 | von Dreusche, Jr. | F23G 5/28 | 432/131 |
| 4,442,782 | A * | 4/1984 | Lilley | F23K 3/06 | 110/225 |
| 4,626,258 | A | 12/1986 | Koppelman | | |
| 4,637,795 | A | 1/1987 | Solano et al. | | |
| 4,728,339 | A | 3/1988 | Koppelman | | |
| 4,741,693 | A | 5/1988 | Solano et al. | | |
| 5,094,177 | A * | 3/1992 | Lado | F23G 5/38 | 110/225 |
| 2007/0062424 | A1* | 3/2007 | Habetz | F23G 5/004 | 110/235 |

* cited by examiner

*Primary Examiner* — Steven S Anderson, II
(74) *Attorney, Agent, or Firm* — Hogan Lovells US LLP

(57) ABSTRACT

A multiple hearth furnace in which in a gas space above at least one hearth an annular baffle is provided above the rabble arms of that hearth. The annular baffle modifies gas flow in the gas space, in particular gas residence times above the hearth. This in turn can enhance performance of the furnace, for example in respect of carbon monoxide emissions.

13 Claims, 8 Drawing Sheets

MULTIPLE HEARTH FURNACE IMPROVEMENTS

CROSS-REFERENCE TO RELATED APPLICATIONS

This application claims priority to Australian patent application no. 2015902122, filed on Jun. 6, 2015. The aforementioned application is incorporated herein by reference in its entirety.

FIELD

This invention relates to multiple hearth furnaces. In addition to improved multiple hearth furnaces, there are provided methods and apparatus for effecting both improvements to existing multiple hearth furnaces, and to certain processes when carried out in them.

BACKGROUND

Known for many decades, multiple hearth furnaces have been used for carrying out, as continuous processes, a range of thermal treatments on an extremely wide range of bulk solid solid materials. These include:

- Incineration and pyrolysis, for example of biosolids from municipal wastewater (that is, sewage) and industrial sludges;
- Calcination, for example of Carbonate materials such as Calcium Carbonate in cement manufacture;
- Drying and dehydration, for example in treatment of bauxite and gypsum;
- Roasting of mineral ores, for example many sulphide ores; and
- Regeneration and recovery, for example of activated carbon, and foundry sands, to name only a few process/material combinations.

The basic multiple hearth furnace arrangement has proven very versatile and has been used over time with a wide range of external solid- and gas-handling components and circuits. Improved design methods and improvements in instrumentation and control have also contributed to their widespread adoption.

In recent years, environmental requirements and energy efficiency have become progressively more important. Sometimes these factors have led, wholly or in part, to adoption of other furnace types in new installations. They may constrain use of multiple hearth furnaces in some applications, despite the many advantages of the type.

Further, there are substantial numbers of existing multiple hearth furnace installations, and there is a desire by users of many of these for ways to upgrade their performance to deal with environmental constraints and fuel efficiency requirements. An additional issue in upgrading of furnace installations may also be a need or desire to operate at higher solids throughputs, due to increasing local population.

Processing of biosolids from municipal wastewater (sewage) provides an illustrative example. Multiple hearth furnaces have been used in this application at least since the 1930s, and for many years were the preferred choice. However, more recently, alternative furnace types such as fluid bed furnaces have been adopted in significant numbers in new installations due to increasingly stringent regulation of gas emissions and due to increasing fuel costs. Operators of multiple hearth furnaces subject to capacity, environmental or other constraints often seek ways to improve them as an alternative to the capital costs of installing replacements or new plant types. There is also a desire for design options that can produce more cost-effective and efficient new multiple hearth furnaces.

Various avenues for improvement of multiple hearth furnaces have been explored, including for example the use of internal and external afterburners—these can be helpful in reducing unwanted emissions, such as Carbon Monoxide (CO), but at the price of increased fuel costs.

The present invention therefore addresses the desire for additional options in the design of new multiple hearth furnaces and for improvements of existing ones and is particularly directed to control of gas residence times. These can be important in the control of emissions, and fuel efficiency, as well as the achievement of close control of changes to the solid material being processed.

The present invention was motivated by the biosolids incineration application, but it is thought that it may have application to other applications of multiple hearth furnaces.

The invention relates to the use of annular baffles above hearths of multiple hearth furnaces. The use of one or more annular baffles in multiple hearth furnaces has been proposed in only two disclosures known to the inventors, namely related U.S. Pat. Nos. 4,626,258 and 4,728,339. However, the present invention is quite different from these disclosures. The combined conical and annular baffles described in these early patents are intended to increase the intimacy of solids/gas contact and appear to reduce, rather than increase average gas residence times above hearths. The annular baffles have a diameter less than that of the central drop holes, so that an entirely different flow pattern would be developed—and the flow pattern developed in the presence of baffles is important in the present invention. There is no disclosure of annular baffles on "in" hearths (as defined below) nor is there disclosure of the use of annular baffles without cooperating conical baffles.

Baffles have been proposed in single hearth furnaces, for the purpose of enabling essentially two-stage treatment processes to be carried out on one hearth; see for example U.S. Pat. Nos. 3,448,012, 4,637,795, and 4,741,693. These show single hearth furnaces in which there are two distinct annular treatment zones, separated by a cylindrical baffle depending from the furnace roof over a hearth. However, these differ from the present invention in that their intention is to distinctly separate the two treatment zones, through minimizing any gap between the baffle lower edge and the material on the hearth immediately below, and so limit leakage of radiant heat and hot gases between the zones. The present invention flows from the surprising discovery that despite the rabble arms imposing a limitation on how small the gap between feed material and baffle can be, there is nevertheless an advantageous effect, albeit in a different type of application.

SUMMARY OF THE INVENTION

In a first aspect, the invention provides a multiple hearth furnace for contacting a feed material with a gas the multiple hearth furnace comprising:

- an external casing having an inner wall surface that is substantially cylindrical;
- a roof structure at an upper end of the external casing;
- a plurality of substantially circular hearths vertically spaced apart from each other within the external casing each hearth comprising an upper surface of a hearth structure and the uppermost hearth being vertically spaced from the roof structure so that directly above each hearth lies a gas space associated with that hearth and each hearth having one of a central drop hole or a plurality of peripherally located drop holes for both downward movement of feed material from that hearth and upward movement of gas into the gas space above that hearth;

a central shaft assembly extending upwardly through the hearth structures and central drop holes and rotatable about an upright axis; and within the gas space above each hearth at least one rabble arm secured to the shaft assembly to rotate therewith and having rabbles adapted to move feed material on that hearth structure towards a central or peripheral drop hole in that hearth, wherein the multiple hearth furnace further comprises above a specific hearth an annular baffle surrounding the rotatable central shaft assembly the annular baffle depending from the hearth structure or roof structure above the specific hearth into the gas space above the specific hearth and having a lower edge located to clear the rabble arms associated with the specific hearth;

and wherein either the annular baffle lies everywhere at a greater radius from the axis than the central drop hole through which the feed material leaves the specific hearth in the case where the specific hearth has a central drop hole or in the case where the specific hearth has peripheral drop holes lies everywhere at a lesser radius than the peripheral drop holes through which the feed material leaves the specific hearth.

Where an annular baffle is used above a hearth having a central drop hole (an "in hearth"), having an inner diameter that is significantly bigger than that of the central drop holes is desirable so that the annular space between the baffle and the shaft assembly, and above the rabble arms, is big enough for gas to flow into and out of it rather than it being substantially a dead zone with little gas flow therein. For the same reason, where the annular baffle is used above a hearth having peripheral drop holes (an "out hearth") it is desirable that the baffle have a diameter significantly smaller than the minimum diameter of the peripheral drop holes.

Preferably, the annular baffle is at least approximately coaxial with the central shaft assembly.

The specific hearth may have a central drop hole through which feed material leaves the specific hearth and through which gas enters the gas space above the specific hearth, the gas subsequently passing outwardly under the annular baffle.

The specific hearth may be the uppermost one of the hearths and have a central drop hole, and gas passing outwardly under the annular baffle may leave the multiple hearth furnace through a gas outlet opening located in one of the roof structure or the external casing and outside the annular baffle.

The gas outlet opening may in particular extend through the substantially cylindrical internal wall of the external casing.

There may be further provided in a gas space above the specific hearth a body that:

extends partway circumferentially around the shaft assembly;

is supported by and moves with one or more rabble arms and is located adjacent to and clear of that annular baffle;

extends downwardly into a gap between circumferentially adjacent ones of the rabble arms, whereby to partially restrict gas flow under that annular baffle.

In a further aspect, the invention provides a method for subjecting feed materials to contact with a flowing gas in a multiple hearth furnace, the multiple hearth furnace comprising:

an external casing having an inner wall surface that is substantially cylindrical;

a roof structure at an upper end of the external casing;

a plurality of substantially circular hearths vertically spaced apart from each other within the external casing each hearth comprising an upper surface of a hearth structure and the uppermost hearth being vertically spaced from the roof structure so that directly above each hearth lies a gas space associated with that hearth and each hearth having one of a central drop hole or a plurality of peripherally located drop holes for both downward movement of feed material from that hearth and upward movement of gas into the gas space above that hearth;

a central shaft assembly extending upwardly through the hearth structures and central drop holes and rotatable about an upright axis; and within the gas space above each hearth at least one rabble arm secured to the shaft assembly to rotate therewith and having rabbles adapted to move feed material on that hearth structure towards a central or peripheral drop hole in that hearth, the method comprising the steps of:

feeding feed material onto at least one hearth of the multiple hearth furnace;

passing the feed material over each hearth by means of the rabbles and downwardly from hearth to hearth by gravity via the drop hole or holes in the hearth structure of each hearth;

simultaneously passing a gas upwardly through the multiple hearth furnace through the drop holes and through the gas spaces above those hearths;

discharging the gas from the multiple hearth furnace through at least one gas outlet; and passing the gas entering the gas space directly above at least one specific hearth under an annular baffle before the gas leaves that gas space, wherein the annular baffle depends from the hearth structure or roof structure above the specific hearth into the gas space and has a lower edge located to clear the rabble arms associated with the specific hearth, and wherein either the annular baffle lies everywhere at a greater radius from the axis than the central drop hole through which the feed material leaves the specific hearth in the case where the specific hearth has a central drop hole or in the case where the specific hearth has peripheral drop holes lies everywhere at a lesser radius than the peripheral drop holes through which the feed material leaves the specific hearth.

Preferably, the annular baffle is at least approximately coaxial with the central shaft assembly.

In one form, the specific hearth is the uppermost one of the hearths.

The specific hearth may comprise a central drop hole.

In one form of the method, at least one hearth is within a combustion zone of the multiple hearth furnace in which combustion zone at least a proportion of the feed material is combusted;

at least one hearth is within a preheating zone of the multiple hearth furnace;

the feed material passes firstly through the preheating zone and thereafter into the combustion zone; and the specific hearth is within the preheating zone.

The method may be a method wherein the feed material comprises biosolids derived from treatment of municipal sewage.

In an application of the method, volatiles liberated from the feed material are at least partially oxidized in the gas that enters the gas space above the specific hearth.

In a further aspect, the invention provides a method for reducing mean gas residence times in a gas space directly above a hearth of a multiple hearth furnace, the multiple hearth furnace comprising:

an external casing having an inner wall surface that is substantially cylindrical;

a roof structure at an upper end of the external casing;

a plurality of substantially circular hearths vertically spaced apart from each other within the external casing each hearth comprising an upper surface of a hearth structure and the uppermost hearth being vertically spaced from the roof structure so that directly above each hearth lies a gas space associated with that hearth and each hearth having one of a central drop hole or a plurality of peripherally located drop holes for both downward movement of feed material from that hearth and upward movement of gas into the gas space above that hearth;

a rotatable central shaft assembly extending upwardly through the hearth structures and central drop holes; and within the gas space above each hearth at least one rabble arm secured to the shaft assembly to rotate therewith and having rabbles adapted to move feed material on that hearth structure towards a central or peripheral drop hole in that hearth, the method comprising the steps of:

feeding feed material onto at least one hearth of the multiple hearth furnace;

moving the feed material over each hearth by means of the rabbles and downwardly from hearth to hearth by gravity via the drop holes in the hearth structure of each hearth;

simultaneously passing a gas upwardly through the multiple hearth furnace through the drop holes and through the gas spaces above those hearths;

discharging the gas from the multiple hearth furnace through at least one gas outlet; and passing the gas entering the gas space directly above a specific hearth to flow under an annular baffle in that gas space before the gas leaves the gas space above the specific hearth, wherein the annular baffle depends from the hearth structure or roof structure above the specific hearth into the gas space and has a lower edge located to clear the rabble arms associated with the specific hearth, and wherein either the annular baffle lies everywhere at a greater radius from the axis than the central drop hole through which the feed material leaves the specific hearth in the case where the specific hearth has a central drop hole or in the case where the specific hearth has peripheral drop holes lies everywhere at a lesser radius than the peripheral drop holes through which the feed material leaves the specific hearth.

Although suspended annular baffles are disclosed herein, some benefit may be obtainable by use of other baffles. Provided some clearance from rabble arms is maintained, any or all of the following conditions could be relaxed in a baffle design: a baffle being circular in horizontal section, so that for example a polygonal shape in section could be used; a baffle being circumferentially endless, so that baffles that are not endless in horizontal section (for example comprising a set of arcuate segments) may provide some benefit; and a baffle that is not concentric with the shaft assembly may provide some benefit. For further example, the lower edge of an annular baffle may have a distance from the surface swept out by the revolving rabble arms that is non-uniform peripherally.

Generally, an aspect of the invention is that gas flow in a gas space above a hearth of a multiple hearth furnace is disrupted by one or more objects placed in that gas space and supported by the structure of the furnace.

BRIEF DESCRIPTIONS OF THE DRAWINGS

DETAILED DESCRIPTION

The invention will be described by reference to modification of an existing multiple hearth furnace used for incinerating biosolids derived from the treatment of sewage. However, it is to be understood that the invention is equally applicable to new manufacture of multiple hearth furnaces and that there is potential for application of the inventive concept or concepts to applications of multiple hearth furnaces other than those intended for biosolids incineration. Multiple hearth furnaces are used for many applications, and on a very wide range of materials, but many of the basic elements described below for incineration are also present in furnaces used in other applications and for other materials.

Figure 1:
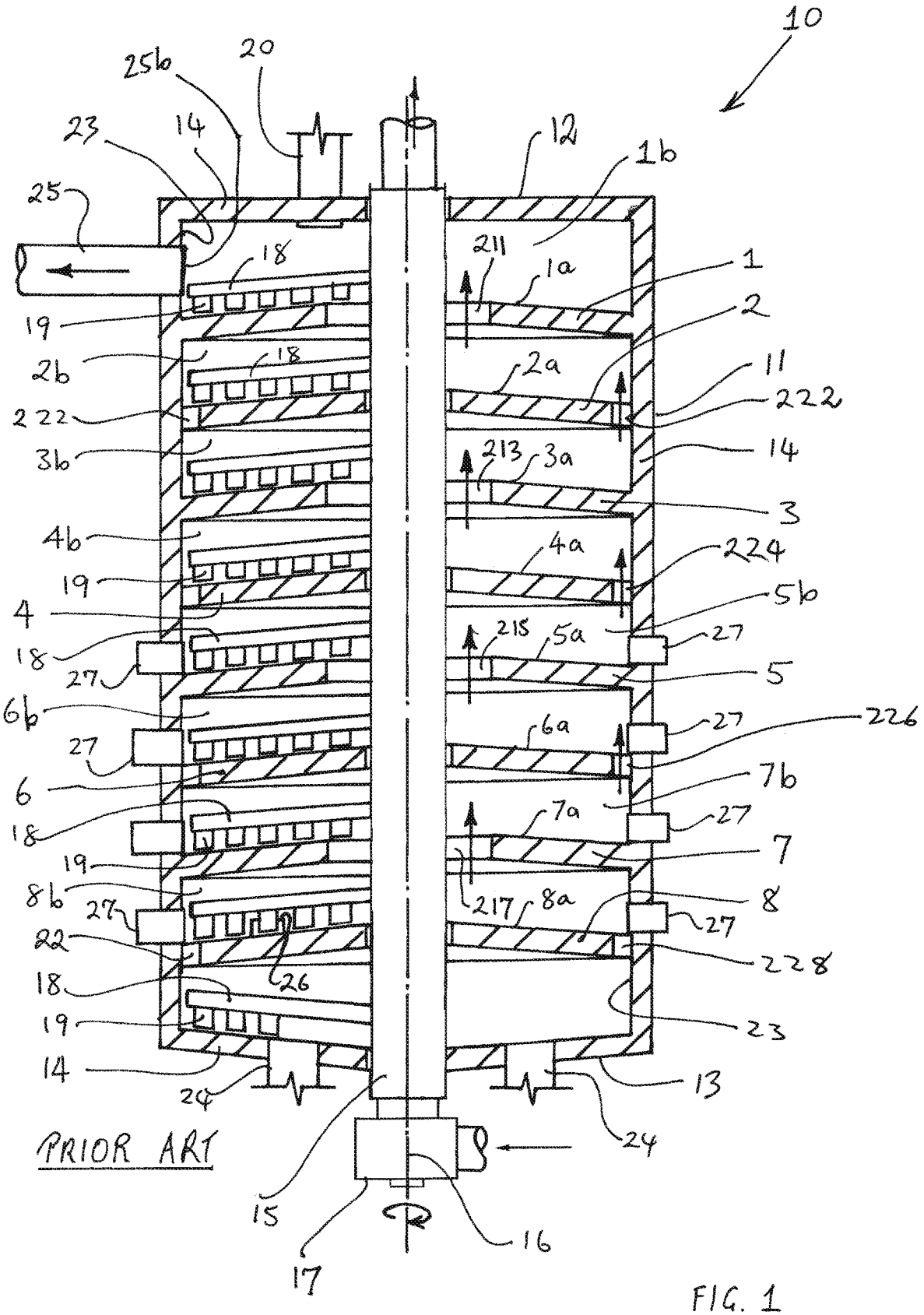
FIG. 1 is a schematic view of a prior art multiple hearth furnace, with some detail omitted, shown in a vertical cross-section whose plane includes the upright axis of rotation of a central shaft assembly.

FIG. 1 shows the basic elements of a typical multiple hearth furnace 10 (for convenience only described below simply as a furnace) 10 as used for incineration of a stream of feed material comprising a proportion of solids that are biosolids derived from treatment of sewage and generally some moisture. In its number of hearths and general proportions, the furnace 10 is representative of the existing furnace that was modeled in the simulations described below.

The furnace 10 comprises a cylindrical housing 11, a roof structure 12, and a bottom structure 13 all typically formed of steel and having a lining of refractory material 14 able to withstand the temperatures generated within the furnace 10. Inside the housing 11 there are eight circular hearth structures, numbered 1 to 8, vertically spaced apart from each other. In the cylindrical housing 11, the refractory lining 14 defines on an inwardly facing inner wall surface 23 that is also cylindrical. The hearth structures 1 to 8 comprise interlocking refractory elements (not shown individually). Upper surfaces of the hearth structures 1 to 8 constitute hearths (numbered 1*a* to 8*a*) which are traversed by feed material (not shown) passing through the furnace 10. Above each of the hearths 1*a* to 8*a* is a gas space (these being numbered 1*b* to 9*b* in FIG. 1), which are traversed by gas passing generally upwardly through the furnace 10.

A shaft assembly 15 extends vertically through the hearth structures 1 to 8 and in operation of the furnace 10 rotates about its axis 16, being driven by a drive mechanism 17. Secured to the shaft assembly 15 and rotated thereby are radially extending rabble arms 18, each provided with depending rabbles 19 (also known as rabble teeth) which in use contact feed material on the hearths so as to move the feed material progressively inwards on some hearths (often referred to in the art as "in" hearths) and outward on other hearths (often referred to in the art as "out" hearths). In FIG. 1, hearths 1*a*, 3*a*, 5*a* and 7*a* are "in" hearths and hearths 2*a*, 4*a*, 6*a*, and 8*a* are "out" hearths. Rabbles 19 in general also agitate the feed material for enhanced contact and reaction with gas flowing over the hearths. For clarity, only one rabble arm 18 is shown above each of hearths 1*a* to 8*a* (and bottom structure 13) in FIG. 1; however in practice a furnace such as furnace 10 would be provided with two, three or four rabble arms for each hearth, circumferentially spaced apart.

The rabble arms 18 have internal passages (not shown) along their length through which is passed cooling gas, delivered by first internal gas passages (not shown) in the shaft assembly 15. Gas passing through each rabble arm is returned to second internal gas passages also, in shaft assembly 15. Means for supplying gas to the shaft assembly are provided but not shown in FIG. 1.

Feed material to be treated in furnace 10 enters through one or more feed inlets 20. Typically all material passing through a feed inlet 20 will fall on to the uppermost hearth 1*a* close to its periphery, however it is possible to provide feed inlets (not shown) for placement of feed material on a hearth other than (or additional to) the uppermost hearth 1*a*.

Feed material flows downwardly through the furnace 10 as follows. Each of the "in" hearths 1*a*, 3*a*, 5*a* and 7*a* has a central drop hole (these being numbered 211, 213, 215, 217 respectively) with a diameter larger than that of shaft assembly 15, and feed material is moved radially inward by the rabble arms 18 and rabbles 19 on each of these hearths and on reaching the central drop hole (211, 213, 215, or 217) falls downward to the "out" hearth below.

Each of the "out" hearths 2*a*, 4*a*, 6*a*, 8*a* has several peripheral drop holes 222, 224, 226, 228 respectively, adjacent to the inner wall surface 23 and feed material falling onto each "out" hearth through the central drop hole (for example, 211) of the "in" hearth immediately above is moved radially outwards by its associated rabble arms 18 and rabbles 19 and falls through the peripheral drop holes (for example 222) onto the "in" hearth below. In the case of the lowermost "out" hearth 8*a*, feed material reaching its peripheral drop holes falls onto bottom structure 13 and a rabble arm 18 acting thereon moves the feed material to a feed outlet 24 (which may be one of several such feed outlets 24) and thus out of furnace 10.

As feed material passes downwardly through the furnace, gas with which that solid material is to be contacted, also passes through the furnace, in a generally upward direction (i.e. opposite to the feed material). As represented by unnumbered arrows in the right half of FIG. 1, the gas passes through the central drop holes 211, 213, 215 and 217 and peripheral drop holes 222, 224, 226 and 228 so as to pass successively through gas spaces 8*b* to 1*b* and radially over each of hearths 8*a* to 1*a*. The gas leaves furnace 10 through a gas outlet opening 25*b* in the wall surface 23 and then gas outlet duct 25 laterally through the cylindrical casing 11. (Furnace 10 has a single gas outlet duct 25, but it would also be possible (though this is not shown) to provide multiple gas outlets in the roof structure 12 or cylindrical housing 11.)

At entry to furnace 10 the gas comprises air, introduced into gas space 8*b* through several air inlets 26 (of which only one is shown) in the cylindrical housing 11. Two burners 27 are provided over each of hearths 5, 6, 7 and 8. Additional air is supplied to furnace 10 via ducts containing the burners 27. On its way upward through furnace 10 to gas outlet duct 25 the gas's composition changes progressively due to combustion of the feed material, liberation of any volatile material comprised in the feed material, combustion of such volatile material, and liberation of water from the feed material. Some of the gas passing through gas outlet opening 25*b* and/or gas emerging from shaft assembly 15 heated by its passage through the rabble arms 18, may be ducted back (by ducts not shown in FIG. 1) to one or more of the lower hearths to augment the flow of air introduced at air inlets 26 and burners 27. This can be a useful fuel-saving measure in incineration applications.

Furnace 10 would in practice be part of a system including other elements, not shown. For example the feed material is typically partially dewatered by suitable plant so as to enter the furnace 10 as a moist and friable cake. For further example, ducts external to the furnace for recirculating outlet gas and/or cooling gas have been mentioned, and are often provided. Importantly, plant to condition gas exiting the system including furnace 10 before its discharge to the atmosphere may be provided.

In normal operation of furnace 10 for incineration, the feed material passes through three distinct zones, each containing at least one of the hearths 1*a* to 8*a*. Feed material entering at feed inlet 20 passes through firstly a preheating zone including one or more of the uppermost hearths, then secondly a combustion zone comprising one or more of the hearths below the hearths of the preheating zone, where substantial combustion of the biosolids occurs, and thirdly a cooling zone in which solid material, now essentially ash, is cooled before discharge from furnace 10 thus preheating the gas rising to the combustion zone. Burners 27 are used to initiate combustion during startup, but some or all may subsequently be able to be turned off with combustion of the feed material being self-sustaining (this being known as autogenous operation). The three zones are not numbered in FIG. 1 as their boundaries can vary, but users often seek to make at least the preheating zone correspond to one or more of the uppermost hearths, above which there is no visible flame.

In the preheating zone, gas which has passed through the combustion zone is cooled by evaporation of moisture from the feed material, and heat is also transferred to the feed material. Some volatile material may be liberated from the feed material in the preheating zone and at least partially combusted there. However, some may reach gas outlet opening 25*b* without having been adequately combusted. This can lead to emissions such as total hydrocarbons and carbon monoxide (CO) that are environmentally unacceptable. There may also be problems with particulates in gas at gas outlet opening 25*b*.

Some multiple hearth furnaces have been fitted with external afterburners (not shown) to condition outlet gas through additional combustion so that emissions are acceptable. Afterburners generally require a fuel supply leading to extra operating cost. The problem of emissions can be exacerbated by excess or unsteady feed material flow. Also, where a multiple hearth furnace is required to handle feed material throughputs that are greater than were contemplated in their original design, unacceptable emission performance can result.

However, as an alternative approach to alleviating emission problems in existing furnaces, or as a new option in the original design of multiple hearth furnaces, the invention provides for inclusion of a baffle in one gas space (or more) which acts to increase average gas residence times therein. It is believed that, particularly when applied to preheating zone hearths, such baffles can allow more complete chemical reactions to occur with resulting benefits for emissions.

Figure 2:
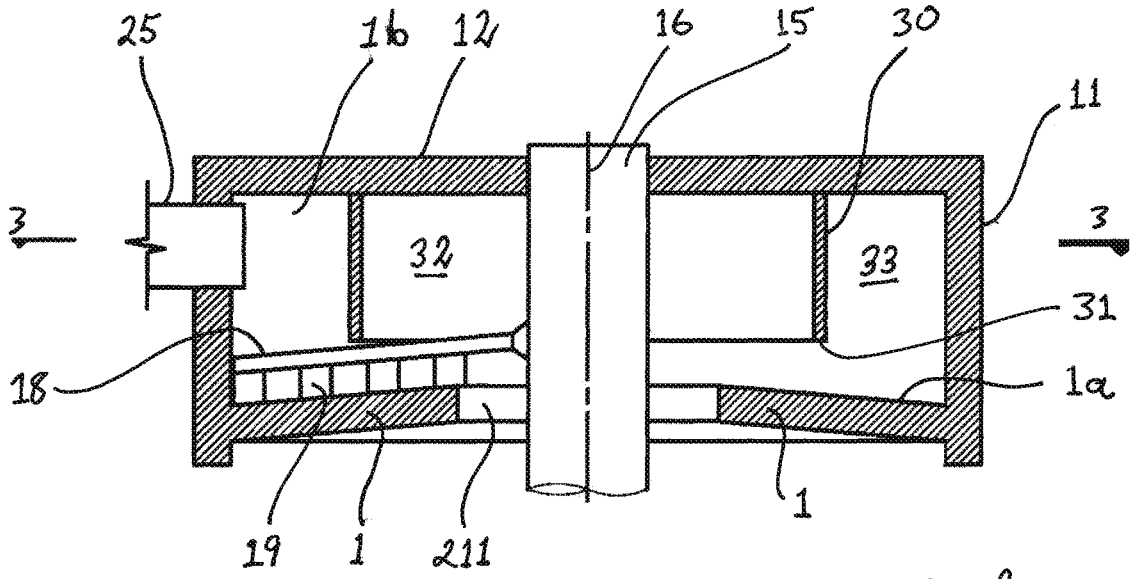
FIG. 2 is a schematic view of a portion of a multiple hearth furnace having an annular baffle according to the invention, with some detail omitted, shown in a vertical cross-section whose plane includes the upright axis of rotation of a central shaft assembly.
Figure 3:
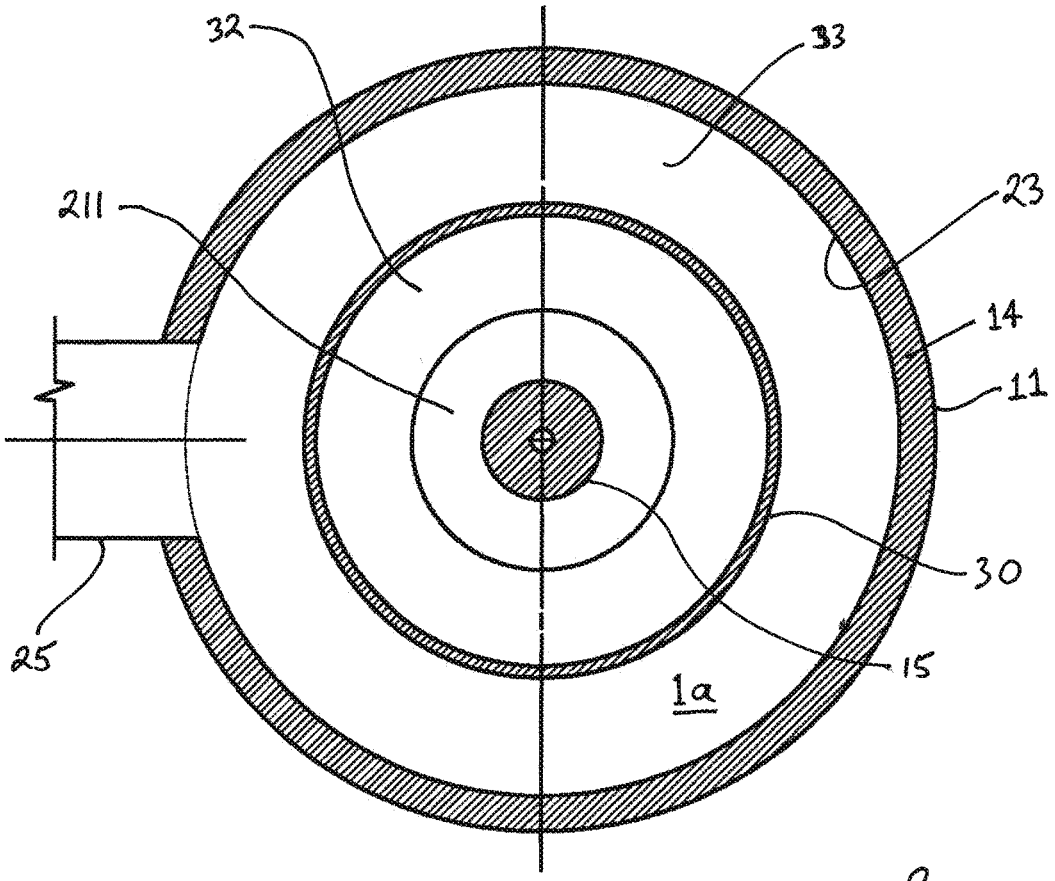
FIG. 3 is a cross sectional view of the multiple hearth furnace portion shown in FIG. 2, the section being taken at station "3-3" of FIG. 2.

FIGS. 2 and 3 show an upper portion of furnace 10, now modified to accord with the invention by provision of annular baffle 30 in the gas space 1*b* above hearth 1*a*, which is an "in" hearth. As in FIG. 1, only one of the rabble arms 18 operating on hearth 1*a* is shown, for clarity. Annular baffle 30 is secured to roof structure 12 and depends therefrom. As best seen in the horizontal cross-section of FIG. 3, baffle 30 is circular, and coaxial with the shaft assembly 15. Baffle 30 has a bottom edge 31 that lies close to rabble arm 18 so that in operation there is no contact between the rabble arm 18 and the baffle 30 and that part of gas space 1*b* above the rabble arms 18 operating on hearth 1*a* is substantially divided by baffle 30 into inner and outer concentric annular spaces 32 and 33. The mean diameter of baffle 30 is shown as being 65% of the diameter of the inner surface 23 of the casing, however, other diameters may be found suitable.

Baffle 30 has a diameter that is larger than the diameter of the central drop hole 211.

In furnace 10, gas outlet duct 25 is of rectangular cross-section and extends horizontally through housing 11, substantially all gas entering gas space 1*b* leaving it through gas outlet opening 25*b* and duct 25. This arrangement is typical of multiple hearth furnace practice, where it is usual to provide for the uppermost hearth to be an "in" hearth, and for gas outlet opening (25*b* in furnace 10) to be at a greater radius than the central drop hole (211 in furnace 10) of that hearth, to ensure the gas traverses hearth 1*a* outwardly and to avoid low average gas residence time in gas space 1*b* above the uppermost hearth.

Based on simulations, discussed below, it is believed that provision of annular baffle 30 modifies the flow in gas space 1*b* so that average gas residence times in gas space 1*b* are greater than when baffle 30 is omitted.

Figure 4:
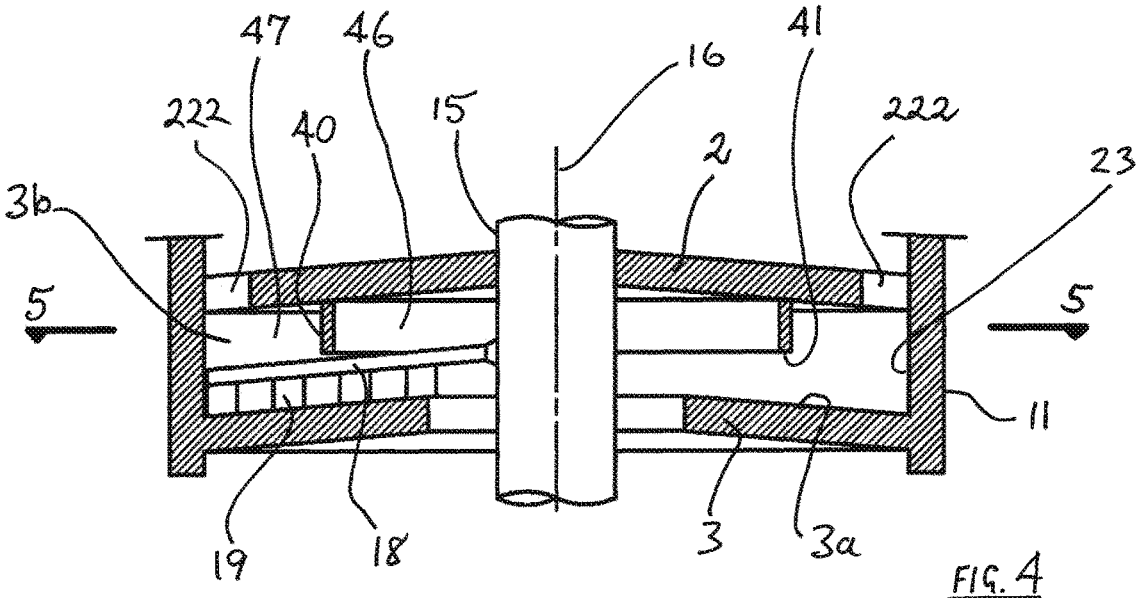
FIG. 4 is a schematic view of a further portion of a multiple hearth furnace having an annular baffle according to the invention, with some detail omitted, shown in a vertical cross-section whose plane includes the upright axis of rotation of a central shaft assembly.
Figure 5:
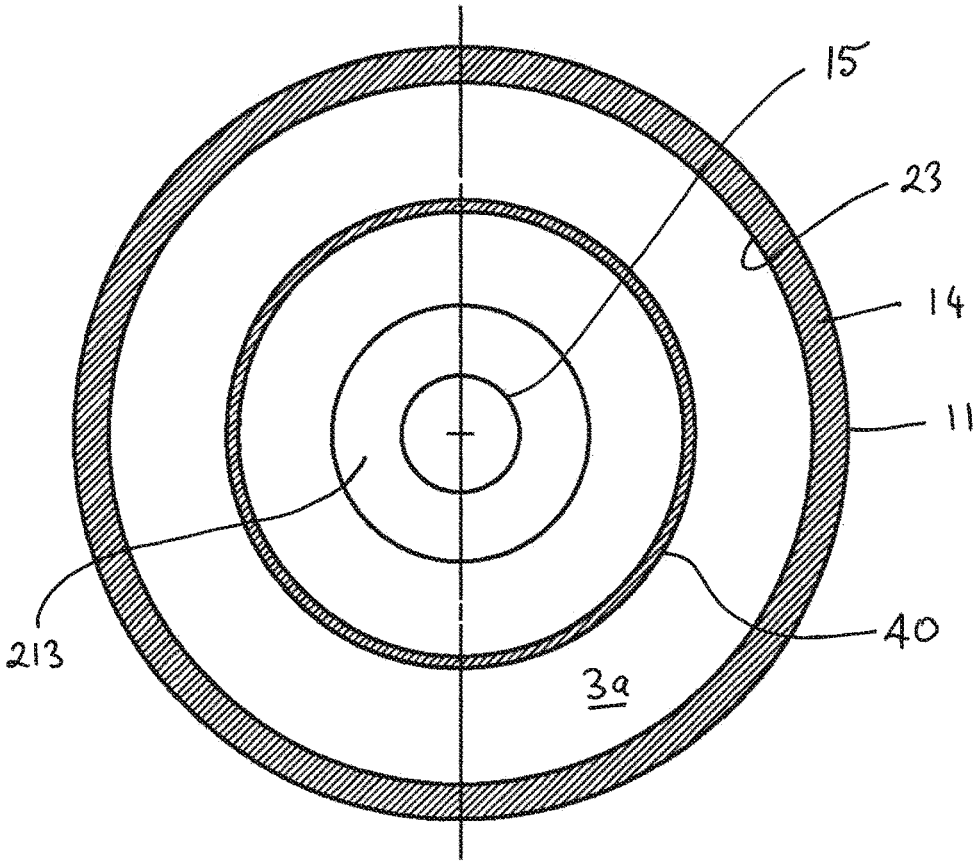
FIG. 5 is a cross sectional view of the multiple hearth furnace portion shown in FIG. 4, the section being taken at station "5-5" of FIG. 4.

An annular baffle may also be provided above a different (or additional) hearth of furnace 10. FIGS. 4 and 5 show another portion of furnace 10, now modified to accord with the invention by provision of annular baffle 40 in the gas space 3*b* above hearth 3*a*, which like uppermost hearth 1*a* is an "in" hearth. As in FIG. 3, only one of the rabble arms 18 operating on hearth 3*a* is shown, for clarity. Annular baffle 40 is secured to hearth structure 2 and depends therefrom, having a bottom edge 41 that lies close to the rabble arm 18 operating on hearth 3*a* so that in operation there is no contact between the rabble arm 18 and the baffle 30. The mean diameter of baffle 30 is shown as being 65% of the diameter of the inner surface 23 of the casing, however, other diameters may be found suitable. Baffle 40 divides that part of space 3*b* into inner and annular spaces 46 and 47 respectively. As with baffle 30, the diameter of baffle 40 is made larger than that of the central drop hole 213 in hearth 3*a*.

In contrast to gas flow in gas space 1*b*, gas entering gas space 3*b* leaves it by passing through the peripheral drop holes 222 that pass through hearth structure 2. Although not shown, the furnace 10 has 20 peripheral drop holes (such as 222) per hearth, a value typical in practice. Accordingly, given that the peripheral drop holes are equispaced around the "out" hearths, the flow above hearth 3*a* when baffle 40 is present is more nearly radial. In this case, too, it has been found in flow simulations that baffle 40 is beneficial in increasing mean and median gas residence times in gas space 3*b*.

It is possible also (or alternatively) to provide an annular baffle (not shown) in one or more "out" hearths, for example hearth 2*a*. Taking hearth 2*a* as an example, gas would enter gas space 2*b* through peripheral drop holes 222 of hearth 2*a* and move towards the central drop hole 211 of the "in" hearth structure 1. It is believed that a baffle above hearth 2*a* similar to that shown for hearth 3*a* in FIG. 4 would partially obstruct the generally radial inward gas flow, increasing mean and median gas residence times in gas space 2.

Figure 6:
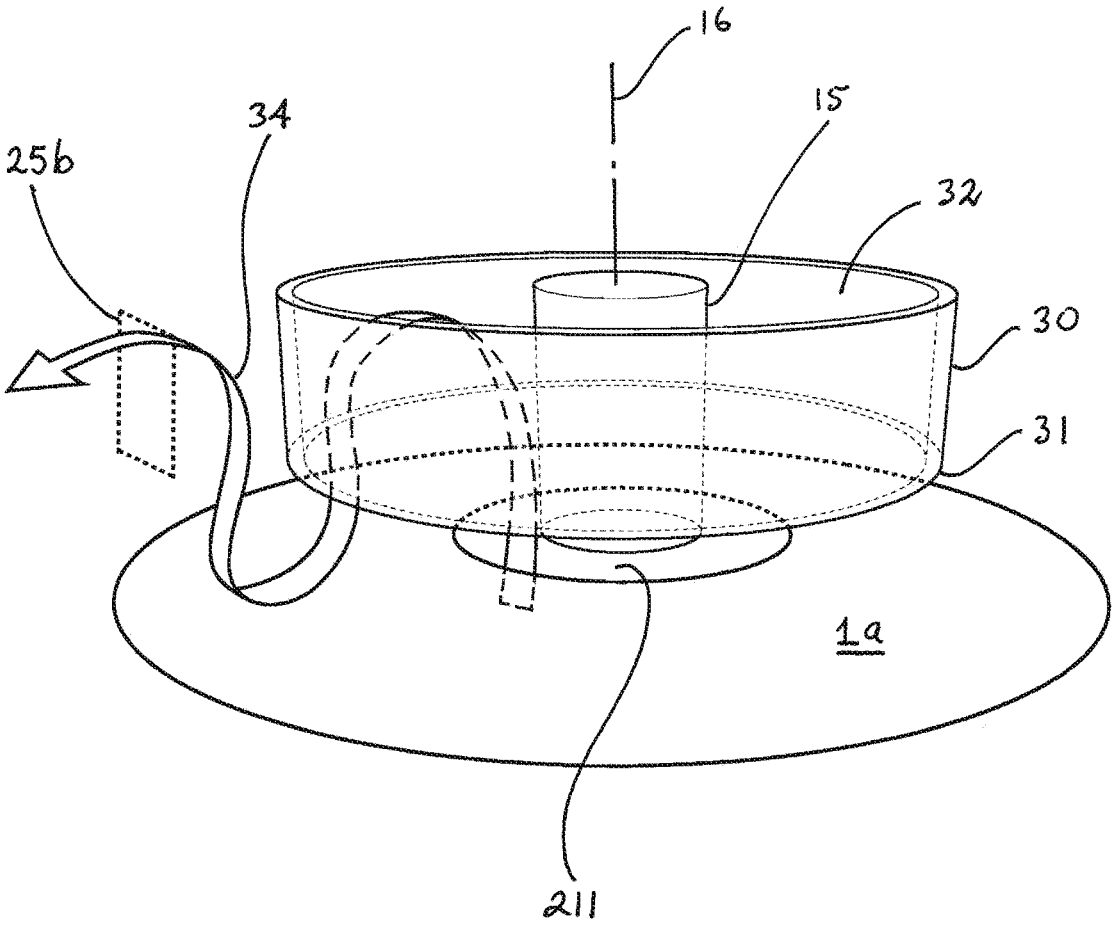
FIG. 6 is a perspective schematic sketch showing a first typical gas streamline in the gas space of a multiple hearth furnace having an annular baffle according to the invention as shown in FIG. 2.
Figure 7:
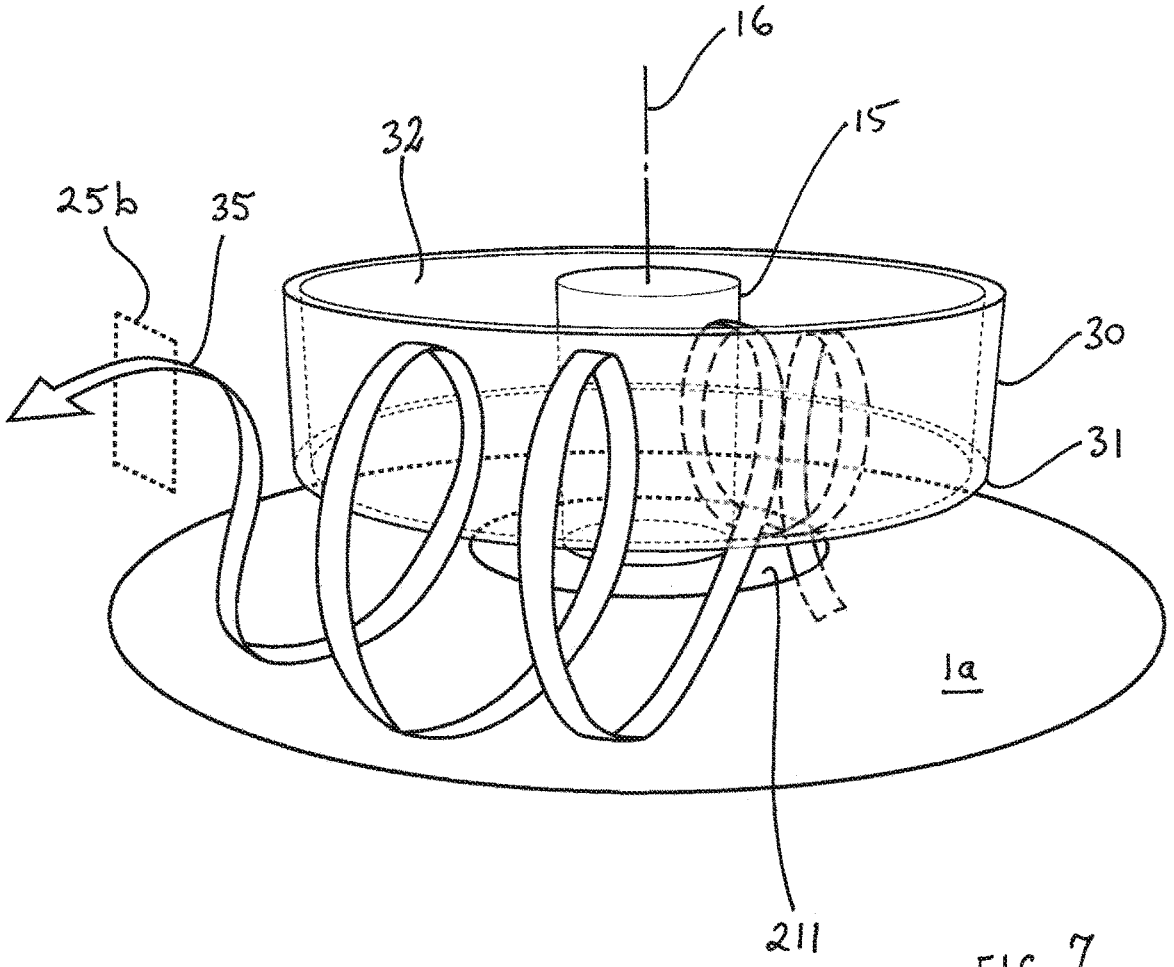
FIG. 7 is a perspective schematic sketch showing a first typical gas streamline in the gas space of a multiple hearth furnace having an annular baffle according to the invention as shown in FIG. 2.

Based on simulations. FIGS. 6 and 7 are approximate sketches of two representative streamlines of gas flow within the gas space 1*b* above hearth 1*a* when baffle 30 is present. In these Figures, the only parts of furnace 10 shown are hearth 1*a*, baffle 30, shaft assembly 15 and central drop hole 211, and gas outlet opening 25*b* is shown only in outline, with other parts of the furnace 10 being omitted for clarity. Streamline 34 illustrates gas rising through central drop hole 211 in a plane including axis 16 and gas outlet opening 25*b*, flowing into space 32 within baffle 30, then under the lower edge 31 and out through gas outlet opening 25*b*. If baffle 30 were not present, gas rising through central drop hole 211 circumferentially close to gas outlet 25 would be expected to stream along a more direct path to gas outlet opening 25*b* with a shorter residence time in gas space 1*b*.

Streamline 35 (FIG. 7) shows gas rising through central drop hole 211 at a point more distant circumferentially from gas outlet opening 25*b* than streamline 34. If baffle 30 were not present, gas rising at this point would be expected to steam upward and around shaft assembly 15 in a more direct path to gas outlet opening 25*b* than that of streamline 35. Streamline 35 passes upward into annular space 32, under edge 31 and around the exterior of baffle 30, with a swirling motion, with a longer residence time in gas space 1*b*.

Figure 8:
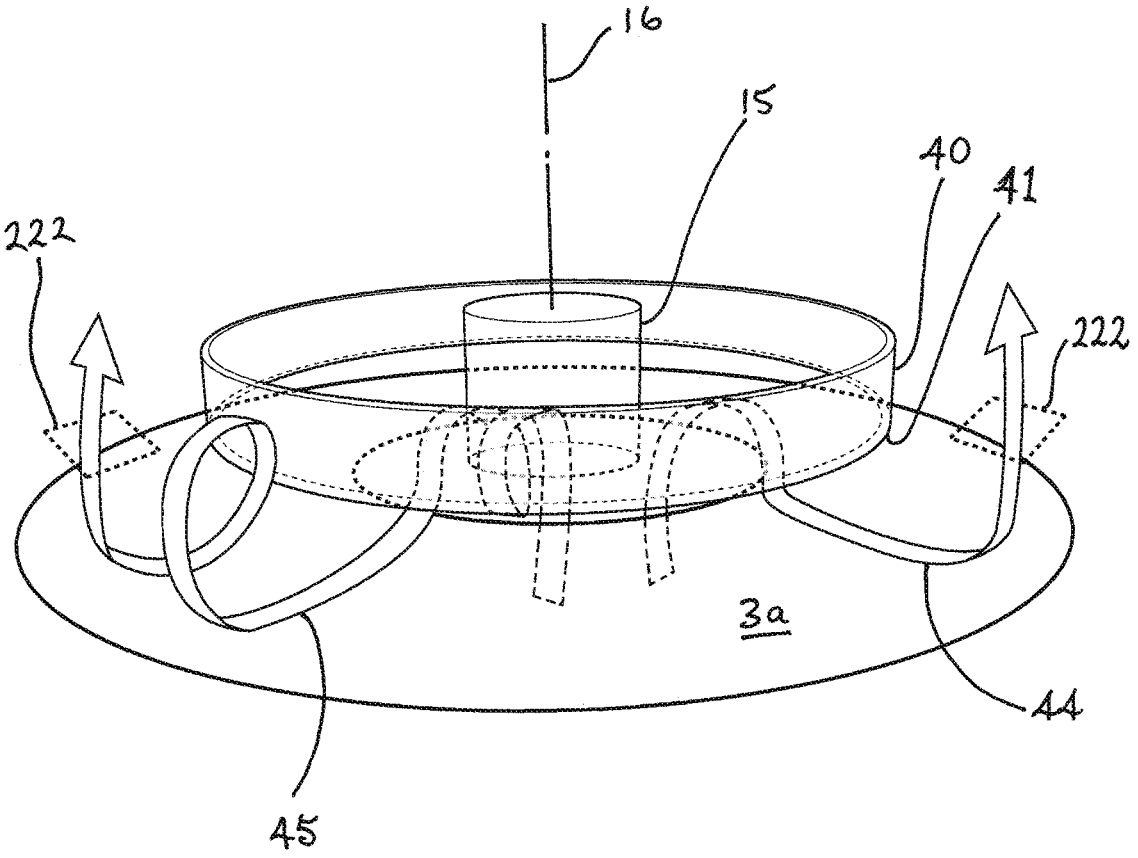
FIG. 8 is a perspective schematic sketch showing two typical gas streamlines in the gas space of a multiple hearth furnace having an annular baffle according to the invention as shown in FIG. 4.
Figure 9:
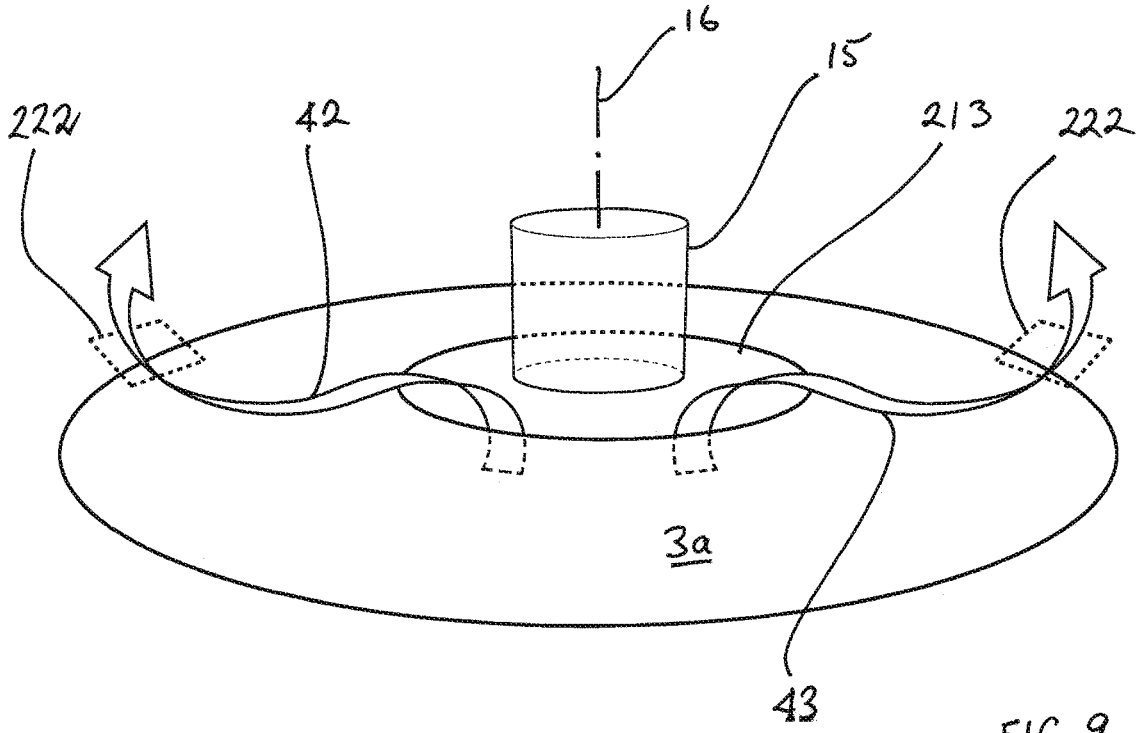
FIG. 9 is a perspective schematic sketch showing two typical gas streamlines in the gas space of a multiple hearth furnace as shown in FIG. 4 but with the annular baffle shown in FIG. 4 no longer present.

FIGS. 8 and 9 are also based on simulations, and are approximate sketches of two representative streamlines of gas flow within gas space 3*b* above hearth 3*a* when baffle 40 is present (FIG. 8) and absent (FIG. 9) respectively. In these Figures, the only parts of furnace 10 shown are hearth 1*a*, baffle 30, shaft assembly 15 and central drop hole 213, and peripheral drop holes 222 are shown only in outline, with other parts of the furnace 10 being omitted for clarity. Streamlines 42 and 43 (FIG. 9) illustrate gas rising through the central drop hole 213 in hearth 3*a* and, with baffle 40 not present, moving radially and upwardly to leave gas space 3*b* through the peripheral drop holes 222 of heath structure 2. Streamlines 44 and 45 (FIG. 8) illustrate the effect of providing annular baffle 40, where gas rises through central drop holes 213 into inner annular space 46, under edge 41 and outwardly and upwardly to peripheral drop holes 222. Some swirl may be developed where the flow is not perfectly radial, as shown by streamline 45.

It is noted that streamlines 34, 35, 42, 43, 44 and 45 are sketches made based on simulations described below, but are not themselves calculated individual streamlines or the results of physical trials.

As mentioned above, the furnace 10, as shown in FIG. 1, is closely representative of an existing furnace in use in incineration of sewage-derived biosolids. As part of an investigation of possible modifications to improve emissions performance, increase throughput and enhance efficiency of this existing furnace, it was modeled by computer simulation for a range of operating conditions and with and without a range of modifications, including annular hearths according to the invention. Physical trials of annular baffles according to the invention have not been carried out.

A 3D CAD (Computer Aided Design) model of the complete furnace 10 was developed and its steady state operation simulated using the commercially available Star CCM+ software package, marketed in the USA by CD-adapco of Melville, N.Y. This package has comprehensive computational fluid dynamics (CFD) capabilities, including flows involving combustion, heat transfer, and chemical reaction all of which were relevant to determination of the gas flows including residence times, temperature distribution, and composition, including outlet $O_2$, $CO_2$ and CO levels. Also, movement of the feed material (including rabbling) was simulated using discrete element modelling (DEM), based on representation of the feed material as individual spherical particles with a range of diameters), a further capability of the software. Models of heating, drying and devolatilisation specific to the particular feed material were developed, based on measured feed material samples using procedures known in the art and the technical literature.

A key quantity of interest in the simulations was carbon monoxide (CO) emissions from furnace 10. Opacity of the emissions was also of interest, and was known to be closely correlated to CO emissions.

The furnace 10 was instrumented and data sets for two steady state operating conditions were obtained and used for validation of the modeling. Detailed measurements were also taken of feed material characteristics and used in the modelling. From the validation work, it was concluded that CO emissions reductions greater than 8% (from a base case) could be considered reliable estimates of what would happen in practice.

The geometry of those parts of furnace 10 as shown in FIGS. 2 to 5 inclusive is substantially representative of the actual furnace modeled. The diameter of the cylindrical inner wall surface was 6 m. The height of the gas space 1*b* above hearth 1*a* (measured at its periphery) was 1.8 m and the height of the gas space 3*b* above hearth 3*a* (also at its periphery) was 0.9 m. The diameter of the central drop holes 211 to 217 was 2.19 m and the nominal diameter of the shaft assembly was 1 m. There were 20 peripheral drop holes 224 to 228 on each "out" hearth each having an area of 0.16 square metres.

The bottom edges 31 and 41 of annular baffles 30 and 40 were each located about 50 mm above the rabble arms 18 operating on their respective hearths. Both annular baffles had an inner diameter of 3.8 m and an outer diameter of 4 m, so that their radial thickness was 100 mm. There was assumed to be no heat conduction through the baffles, consistent with their comprising refractory material or surfaces.

Although the gas flow simulations took account of the presence of the rabble arms 18, their (low) rotational speed was taken to be zero, so as to decouple the gas flow and feed material movement computations. Effects on gas flow of movement of feed material through the gas (i.e. in the central and peripheral drop holes 211, 213, 215, 217, 222, 224, 226 and 228) and between the feed material inlet 20 and feed material on hearths 1*a*, 3*a* were neglected as insignificant. The simulations included recirculation of shaft cooling air.

The giving of these dimensions of the furnace 10 as simulated is not intended to be a limitation on the spirit or scope of the invention, which a person of ordinary skill in the art may adapt for application in multiple hearth furnaces of other sizes and proportions and in different applications, wherever it is found (for example by actual trial or by simulation) to be suitable.

Of the simulations carried out, the following were relevant to the present invention. All simulations were for steady state operation.

Simulation D1—This provided a base case, and was representative of normal operation of furnace 10 without any annular baffles fitted. Feed rate was set at 41 tonnes/day, fed to hearth 1*a*. The moist feed material comprised 34.4% solids, and the excess (over stoichiometric) air supply was 43.6%. The combustion zone was confined to hearths 2*a* and 3*a*. Steady state autogenous combustion (i.e. burners not in operation) was simulated.

Simulation D2—This was the same as base case D1 in all respects, except that the feed rate was made 50 tonnes/day.

Simulation E12—This was the same as base case D1 in all respects, including the feed rate and characteristics, but with provision of an annular baffle over hearth 1*a* (only) as shown in FIGS. 2 and 3.

Simulation E13—This was the same as simulation E12 in all respects, except that the feed rate was set at 50 tonnes/day.

Simulations E12 and E13 both showed reductions of furnace CO emissions by at least about 80% relative to the base cases D1 and D2 respectively. More precision cannot be given due to the uncertainty in resolvable reductions mentioned above.

Some further simulations were made involving a baffle above hearth 3*a* (only). These were as follows:

Simulation O5—This simulation was carried out to test the effect of providing an annular baffle (as shown in FIGS. 4 and 5) above hearth 3*a* (only) and introducing all feed material at hearth 3*a*, rather than hearth 1*a*. The feed rate was 41 tonnes/day, feed material, excess air 43.6% over stoichiometric. The combustion zone was confined to hearth 5*a*. Again, autogenous combustion (i.e. burners not in operation) was simulated. (Note: The feed material was slightly drier than in simulations D1, D2, E12 and E13, with solids content of 39.4%.)

Simulation O6—this was the same as O5 in all respects, except feed rate was increased to 50 tonnes/day. Autogenous combustion (i.e. burners not in operation) was simulated.

Simulations O5 and O6 also showed reductions of furnace CO omissions of at least about 80% relative to base cases D1 and D2 respectively. While the drier feed material and its introduction at hearth 3 prevent the effect of the baffle alone being isolated in these results, they do suggest that baffles above lower hearths can, at the least, also be consistent with enhanced furnace emission performance. Mean gas particle residence times for the hearth having an annular baffle in these simulations were increased by comparison to the relevant base cases.

While the simulations were detailed and complex in principle, they were within the current state of the art, as applied to furnaces of various types and other equipment and phenomena. However, it was noted that increased gas particle mean residence times in gas spaces with annular baffles were evidently the key to the effects of those baffles. Moreover, it will be apparent from FIGS. 6 to 9 that flow patterns were affected by the baffles and lead to increased mean gas particle residence times. Accordingly, the potential applicability of annular baffles where increased gas particle residence times could be expected to enhance performance, is considered clear. This may include multiple hearth furnaces of different sizes or proportions, provision of annular baffles above more than one hearth of a furnace, and applications involving other feed materials and types of treatment than those simulated in detail.

Similarly, the invention may be applied by providing annular baffles in the gas spaces above "out hearths" instead of (or in addition to) "in hearths".

Figure 10:
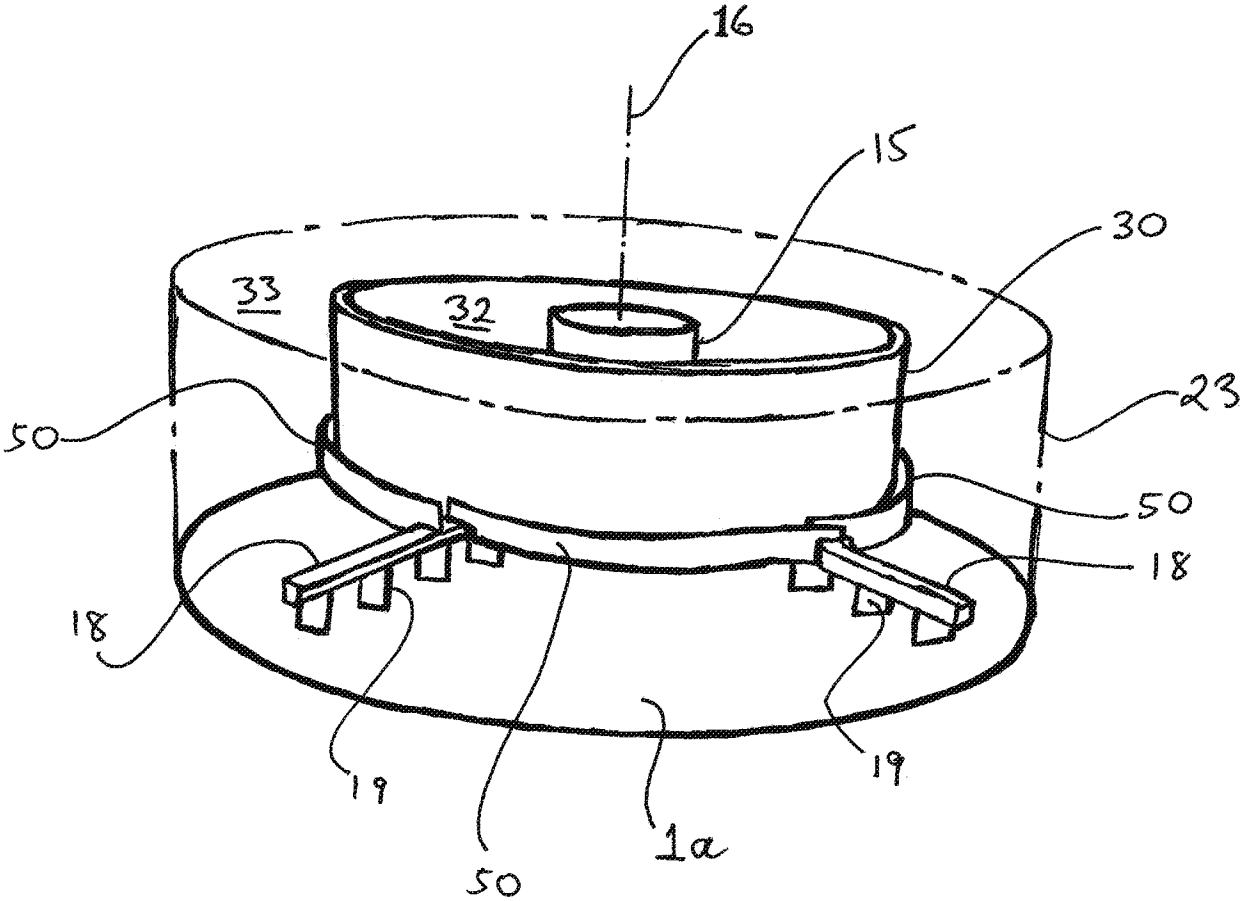
FIG. 10 is a perspective view showing one hearth of the furnace as shown in FIGS. 2 and 3, rabble arms thereon and baffles according with an embodiment of the invention.

A modified version of the invention will now be described by reference to FIG. 10. FIG. 10 shows the uppermost hearth 1*a* of furnace 10, portions of two of the rabble arms 18 operating on hearth 1*a*, and annular baffle 30. For clarity the inner wall surface 23 of the casing 11 is shown by chain-dotted lines only. Although the uppermost hearth 1*a* is shown in FIG. 10, and referred to in the explanation below, the modification can be applied to any hearth of a multiple hearth furnace.

The requirement for clearance for baffle 30 above rabble arms 18 means that between bottom edge 31 of baffle 30 and feed material on hearth 1*a*, there may be a considerable gap. In some circumstances it may be desirable to reduce that gap somewhat, despite the presence of rabble arms 18. This can be achieved by providing additional baffle elements 50 that are secured to and/or supported on rabble arms 18 so as to revolve around axis 16, and that extend downward between circumferentially adjacent rabble arms 18. Each baffle element 50, of which one is provided per rabble arm 18, is arcuate with a radius about axis 16 similar to but not the same as the radius of baffle 30 and located radially so as to clear baffle 30. Each baffle element 50 is supported on two adjacent rabble arms 18. Although the need for clearance from baffle 30 means that baffle elements 50 are not sealingly connected to baffle 30, they do provide a disruption additional to that of baffle 30 to gas flow from central drop hole (for example, 211 in the case of hearth 1*a*) to the gas outlet 25.

Each baffle element 50 may be secured to a rabble arm 18 by a pin (not shown) to the rabble arm 18 at its leading end (based on the direction of rotation) and simply sit on top of the rabble arm 18 at its trailing end, so that there is a degree of freedom of movement of the baffle elements 50. This allows for the fact that rabble arms 18 may sag or otherwise move in use.

The invention claimed is:

1. A multiple hearth furnace for contacting a feed material with a gas, the multiple hearth furnace comprising:

a plurality of circular hearths vertically spaced apart from each other within a cylindrical external casing, the uppermost hearth being vertically spaced from a roof structure of the external casing so that directly above each hearth lies an associated gas space, each hearth being either an in hearth configured to enable downward movement of feed material and upward movement of gas through a central drop hole or an out hearth configured to enable downward movement of feed material and upward movement of gas through a plurality of peripherally located drop holes;

a shaft assembly extending upwardly and centrally through the gas spaces and rotatable about an upright axis;

rabble arms, within each gas space, secured to the shaft assembly to rotate therewith and each of the rabble arms having rabbles adapted to move feed material inwardly where the hearth associated with the gas space is an in hearth or outwardly where the hearth associated with the gas space is an out hearth; and an annular baffle comprising a wall that is cylindrical and has an upright axis, located in the gas space above a specific circular hearth of the plurality of circular hearths, the annular baffle secured to and extending downwardly from the roof structure or hearth above the specific circular hearth to a lower edge that, in operation of the furnace, is clear of the rabble arms associated with the specific circular hearth so as divide the gas space above the lower edge into inner and outer annular spaces, and wherein the annular baffle surrounds the rotatable central shaft assembly and lies everywhere at a greater radius from the axis than the central drop hole where the specific hearth is an in hearth or everywhere at a lesser radius than the peripheral drop holes where the specific hearth is an out hearth.

2. The multiple hearth furnace of claim 1 wherein the upright axis of the annular baffle is coaxial with the central shaft assembly.

3. The multiple hearth furnace of claim 1 wherein the specific hearth is an in hearth so that feed material leaves the specific hearth and gas enters the gas space directly above the specific hearth through the central drop hole of the specific hearth, the gas subsequently passing outwardly under the annular baffle.

4. The multiple hearth furnace of claim 3 wherein the specific hearth is an in hearth and is the uppermost one of the hearths, and wherein gas passing outwardly under the annular baffle leaves the gas space directly above the specific hearth through a gas outlet opening that extends through one of the roof structure or the external casing and outside the annular baffle.

5. The multiple hearth furnace of claim 1 wherein there is further provided in the gas space directly above the specific hearth, and below the roof structure or hearth above the specific hearth, a baffle element that:

extends partway circumferentially around the shaft assembly and is located adjacent to and clear of the annular baffle;

is supported by and rotates with a circumferentially adjacent pair of the rabble arms in the said gas space;

extends downwardly into a gap between the circumferentially adjacent pair of the rabble arms in the said gas space, whereby to partially restrict gas flow under the annular baffle.

6. A method for subjecting feed materials to contact with a gas in a multiple hearth furnace, the multiple hearth furnace comprising:

a plurality of circular hearths vertically spaced apart from each other within a cylindrical external casing and the uppermost hearth being vertically spaced from a roof structure of the external casing so that directly above each hearth lies an associated gas space, each hearth being either an in hearth having for downward movement of feed material and upward movement of gas a central drop hole or an out hearth having for downward movement of feed material and upward movement of gas a plurality of peripherally located drop holes;

a shaft assembly extending upwardly and centrally through the gas spaces and rotatable about an upright axis; and within each gas space rabble arms secured to the shaft assembly to rotate therewith and each having rabbles adapted to move feed material inwardly where the hearth associated with the gas space is an in hearth or outwardly where the hearth associated with the gas space is an out hearth, the method comprising the steps of:

providing, in the gas space above a specific circular hearth of the plurality of circular hearths, an annular baffle that comprises a wall that is cylindrical and has an upright axis and that is secured to and extends downwardly from the roof structure or hearth above the specific circular hearth to a lower edge that, in operation of the furnace, is clear of the rabble arms associated with the specific circular hearth so as to divide the gas space above the lower edge into inner and outer annular spaces, the annular baffle surrounding the rotatable central shaft assembly and lying everywhere at a greater radius from the axis than the central drop hole where the specific hearth is an in hearth or everywhere at a lesser radius than the peripheral drop holes where the specific hearth is an out hearth;

feeding feed material onto the uppermost hearth;

passing the feed material over each hearth by means of the rabbles and downwardly from the uppermost hearth to successively lower hearths;

simultaneously passing a gas upwardly through the furnace through the drop holes of each out hearth and through the drop hole of each in hearth and through the gas spaces directly above the hearths.

7. The method of claim 6 wherein the upright axis of the annular baffle is coaxial with the central shaft assembly.

8. The method of claim 6 wherein the specific hearth is the uppermost one of the hearths.

9. The method of claim 8 wherein the specific hearth is an in hearth.

10. The method of claim 6 wherein at least one hearth is within a combustion zone of the multiple hearth furnace in which combustion zone at least a proportion of the feed material is combusted;

the specific hearth is within a preheating zone of the multiple hearth furnace;

the feed material passes firstly through the preheating zone and thereafter into the combustion zone.

11. The method of claim 6 wherein volatiles liberated from the feed material are at least partially oxidized in the gas that enters the gas space above the specific hearth.

12. The method of claim 6 wherein the feed material comprises biosolids derived from treatment of municipal sewage.

13. A method for modifying a multiple hearth furnace to increase gas residence times therein, the multiple hearth furnace comprising:

a plurality of circular hearths vertically spaced apart from each other within a cylindrical external casing and the uppermost hearth being vertically spaced from a roof structure of the external casing so that directly above each hearth lies an associated gas space, each hearth being either an in hearth having for downward movement of feed material and upward movement of gas a central drop hole or an out hearth having for downward movement of feed material and upward movement of gas a plurality of peripherally located drop holes;

a shaft assembly extending upwardly and centrally through the gas spaces and rotatable about an upright axis; and within each gas space rabble arms secured to the shaft assembly to rotate therewith and each having rabbles adapted to move feed material inwardly where the hearth associated with the gas space is an in hearth or outwardly where the hearth associated with the gas space is an out hearth, the method comprising the step of:

providing, in the gas space above a specific circular hearth of the plurality of circular hearths, an annular baffle that comprising a wall that is cylindrical and has an upright axis and that is secured to and extends downwardly from the roof structure or hearth above the specific circular hearth to a lower edge that, in operation of the furnace, is clear of the rabble arms associated with the specific circular hearth so as to divide the gas space above the lower edge into inner and outer annular spaces, the annular baffle surrounding the rotatable central shaft assembly and lying everywhere at a greater radius from the axis than the central drop hole where the specific hearth is an in hearth or everywhere at a lesser radius than the peripheral drop holes where the specific hearth is an out hearth.

* * * * *